US006450050B1

(12) United States Patent
Luo et al.

(10) Patent No.: US 6,450,050 B1
(45) Date of Patent: Sep. 17, 2002

(54) WALKING BEAM BALANCED SPAN AND MOMENT REGULATING ECONOMIZED OIL PUMP AND A STROKE REGULATING DEVICE OF THE SAME

(75) Inventors: Renquan Luo; Changle Gao; Xiangyun Ji; Xuelu Zhang; Shujian Ma, all of Wulumuqi (CN)

(73) Assignee: No. 3 Machine Tool Plant of the Xinjiang Uygur Autonomous Region, Autonomous Region (CN)

( * ) Notice: Subject to any disclaimer, the term of this patent is extended or adjusted under 35 U.S.C. 154(b) by 0 days.

(21) Appl. No.: 09/538,175

(22) Filed: Mar. 30, 2000

(51) Int. Cl.[7] ..... F16H 21/20; F04B 49/00
(52) U.S. Cl. ..... 74/41; 74/590
(58) Field of Search ..... 74/41, 589, 590; 417/321

(56) References Cited

U.S. PATENT DOCUMENTS 1,293,608 A * 2/1919 Dayton ..... 74/41
3,006,201 A * 10/1961 Ross ..... 74/41
4,377,092 A * 3/1983 Garmong ..... 74/41

* cited by examiner

*Primary Examiner*—William C Joyce
(74) *Attorney, Agent, or Firm*—Patterson, Thuente, Skaar & Christensen, P.A.

(57) ABSTRACT

A walking beam balanced span and moment regulating oil pump having an arc, a walking beam, a support, a pitman, a base, a crank, a decelerator, a power machine, and a string device. The upper part or the lower part of the front end of a boom is articulated to the rear end of the walking beam, and between the lower part or the upper part of the boom and the rear end of the walking beam is placed a weighted arm regulator, and a weighted device is installed on the end of the boom. The walking beam balanced span and moment regulating oil pump is simple in structure, easy to operate, reliable in performance and less costly than conventional devices.

4 Claims, 6 Drawing Sheets

WALKING BEAM BALANCED SPAN AND MOMENT REGULATING ECONOMIZED OIL PUMP AND A STROKE REGULATING DEVICE OF THE SAME

FIELD OF THE INVENTION

The present invention relates to a mechanical aparatus that extracts underground materials such as oil and so forth. It is a walking beam balanced span and moment regulating economized oil pump and a walking beam oil pump stroke regulating device, the latter of which is especially applicable to fore and rear walking beam oil pumps.

BACKGROUND OF THE INVENTION

There are a variety of oil pumps which normally fall into the following categories: walking beam oil pumps and non-walking beam oil pumps in terms of the presence of the walking beam; conventional walking beam oil pumps, fore walking beam oil pumps, offset walking beam oil pumps and special-shaped walking beam oil pumps in terms of their structure; crank balance walking beam oil pumps, sidespin walking beam oil pumps, rotary walking beam oil pumps, suspended walking beam oil pumps and double-head walking beam oil pumps in terms of their mode of balance; and motor-driven and diesel-driven walking beam oil pumps in terms of the driving mode.

At present, a walking beam oil pump typically consists of an arc, a walking beam, a support, a pitman, a base, a crank, a decelerator, a power machine, and a string device. The support crank, decelerator, power machine and so on are fixed onto the base of the oil pump and the walking beam is hinged to the support via the central bearing. The pitman is hinged to the crank at one end, and to the walking beam through a bearing at the other end. The arc, on which is mounted the string device, is installed at the front end of the walking beam.

When the oil pump is in operation, the load applied to the string device is called the arc suspension point load. The arc suspension point load varies around a maximum value during the upward oscillation or the up stroke of the arc, and the arc suspension point load varies in the vicinity of a minimum value during the downward oscillation or the down stroke of the arc. Therefore, the power machine is required to produce a large amount of energy during the up stroke whereas in the down stroke, the power machine has to do negative work due to the gravitation instead of producing a large amount of energy. Thus, in order to reduce such irregularity of load, balance devices are attached to oil pumps. However, although some of the oil pumps succeed in saving energy by means of the above-mentioned balance devices, there are many drawbacks with them, such as, complicated structures, poor balance performance, huge dynamic load, high energy consumption, low reliability, inconvenient operation and high costs of maintenance.

In particular, when some under-well technological parameters, such as the diameter of the oil pump, the depth of the deployment of the pump have been changed or when the viscosity of the oil and so on have varied, the difference between the maximum and minimum values of the oil arc suspension point load also varies accordingly. The output of the power machine has to be increased to adapt the oil pumps to such changes, which, however, inevitably increases the consumption of energy.

Cranes are usually needed to adjust the stroke of the conventional waking beam type oil pumps. This is achieved by hoisting the arc first with the crane, then the crank pin assembly connected to the pitman is taken out of the stroke regulating hole of the crank and then mounted in the stroke regulating holes of the crank to which the adjustment is to achieve. The stroke adjustment is not completed until the arc is deposited down and the crane has been driven away. Thus, a complicated series of procedures must be followed whenever adjustment of the stroke is needed, which costs a lot of time and labour, greatly influencing the efficiency of productivity.

SUMMARY OF THE INVENTION

With a view to the above problems, one object of the present invention is to provide a walking beam balanced span and moment regulating economized oil pump whose balance can be modified as the difference between the maximum and the minimum values of the arc suspension point load changes. The present invention may further adjust its balance along with the variation of the difference between the maximum and the minimum values of the arc suspension point load.

Another object of the present invention is to overcome the deficiencies of the conventional technology and to provide stroke regulating device applying to a walking beam oil pump which is simple in structure, easy to operate, time-saving and labour-saving.

According to the first aspect of the present invention, the walking beam balanced span and moment regulating economized oil pump consisting of an arc, a walking beam, a support, a pitman, a base, a crank, a decelerator, a power machine, and a string device, is characterized in that the upper or lower part of the front end of the boom is hinged to the rear end of the walking beam while between the lower or upper part of the front end of the boom and the rear end of the walking beam is mounted a weighted arm regulator, and at the rear end of the boom is mounted a weighted device. The boom is made up of at least two segments, each of which is hinged upon each other at the upper part or the lower part of its front end, and between the lower part and the upper pat of the front end of each of the segments is mounted a weighted arm regulator. The weighted arm regulator consists of an adjustable pin roll and a mounting hole, and at the lower part of the front end of the boom there is a mounting hole whose diameter is larger than that of the adjustable pin roll, which is placed between the front end of the boom and the rear end of the waling beam through the hole. A seizure is fixed at the top of the boom corresponding to the mounting hole or at the end of the walking beam, and the seizure comprises at least one seizure notch. The weighted arm regulator consists of a wedge and a lead screw, in which a base plate of the is lead screw is fixed at the front end of the boom or the rear end of the walking beam, and the lead screw is seated on the base plate with the wedge fixed on it. The weighted arm regulator consists of a screw ejector pin and a screw ejector pin base, the latter of which is fixed at the front end of the boom or the rear end of the walking beam and the former mounted on the screw ejector pin base. The weighted means, which is hinged or articulated on the rear end of the boom, consists of an upper weighted box hinged or articulated on the rear end of the boom and at least one lower weighted box which can be mounted on the upper weighted box or removed from the upper weighted box. An unloading bumper bracket is mounted on the base corresponding to the lowest point of the weighted means. The boom is thick at the upper part and thinner at the lower part, thus constituting a uniform strength beam. The boom and the walking beam constitute either a trapezium or an angle or at, arc.

According to the second aspect of the present invention, a walking beam stroke regulating device consisting of an arc, a wailing beam, a support, a pitman, a base, a crank, a decelerator, a power machine, and a string device, is characterized in that the fixing end of the stroke regulating strutting is positioned on the support or the walking beam, and the walking beam or the support corresponding to the strutting end of the stroke regulating strutting has a hinge housing, on which installed by the strutting end of the stroke regulating strutting when regulating the stroke. A guide sleeve is located at the fixing end of the stroke regulating strutting, and the fixing end is constituted by a flexible joint mounted together with the guide sleeve via restrictingnuts. The flexible joint is hinged to the hinge housing of the support or the base of the walking beam, that is, it is connected to the hinge housing of the support or the base of the walking beam with a rotable pin. A nut is placed at the strutting end of the stroke regulating strutting, and a turnbuckle is mounted on the strutting end through the screw nut. There is a restrictingscrew nut inside of the turnbuckle. The strutting end of the stroke regulating strutting is hinged on the hinge housing. The strutting end of the stroke regulating strutting is hinged on the hinge housing via a rotable pin. A split pin is mounted on the rotable pin. There is a hinged lever hole opened on the stroke regulating strutting.

BRIEF DESCRIPTION OF THE DRAWINGS

The present invention will be explained in more detail in conjunction with the appending drawings.

FIG. 11 is a partial view from the direction of A illustrated in FIG. 10, wherein:

1 an arc, 2 a walking beam, 3 a bearing, 4 a pitman, 5 a central bearing, 6 a support, 7 a boom, 8 a weighted device, 9 an unloading bumper bracket, 10 a power machine, 11 a decelerator, 12 a crank, 13 a base, 14 a string device, 15 a screw ejector pin, 16 a screw ejector pin base, 17 a baffle plate, 18 a pin, 19 an adjusting pin, 20 a seizure, 21 a bearing plate, 22 an abutment, 23 a pipe rack, 24 a wedge, 25 a lead screw, 26 a lead screw base, 27 a bearing, 28 a bearing cap, 29 a hanging bearing, 30 a bearing housing, 31 an upper weighted box, 32 a weighted block, 33 a lower weighted box, 34 a connecting frame, 35 a screw bolt, 36 a bolt washer, 37 a lock nut, 38 a rotable pin, 39 a holding yoke, 45 is a crank pin assembly, 46 a stroke regulating strutting, 47 a hinge housing, 48 a turnbuckle, 49 a screw nut, 50 a restricting nut, 51 a pipe body, 52 a joint, 53 a split pin, 54 a rotable pin, 55 a guide sleeve, 56 a hinged lever hole.

DESCRIPTION OF PREFERRED EMBODIMENTS

Figure 1:
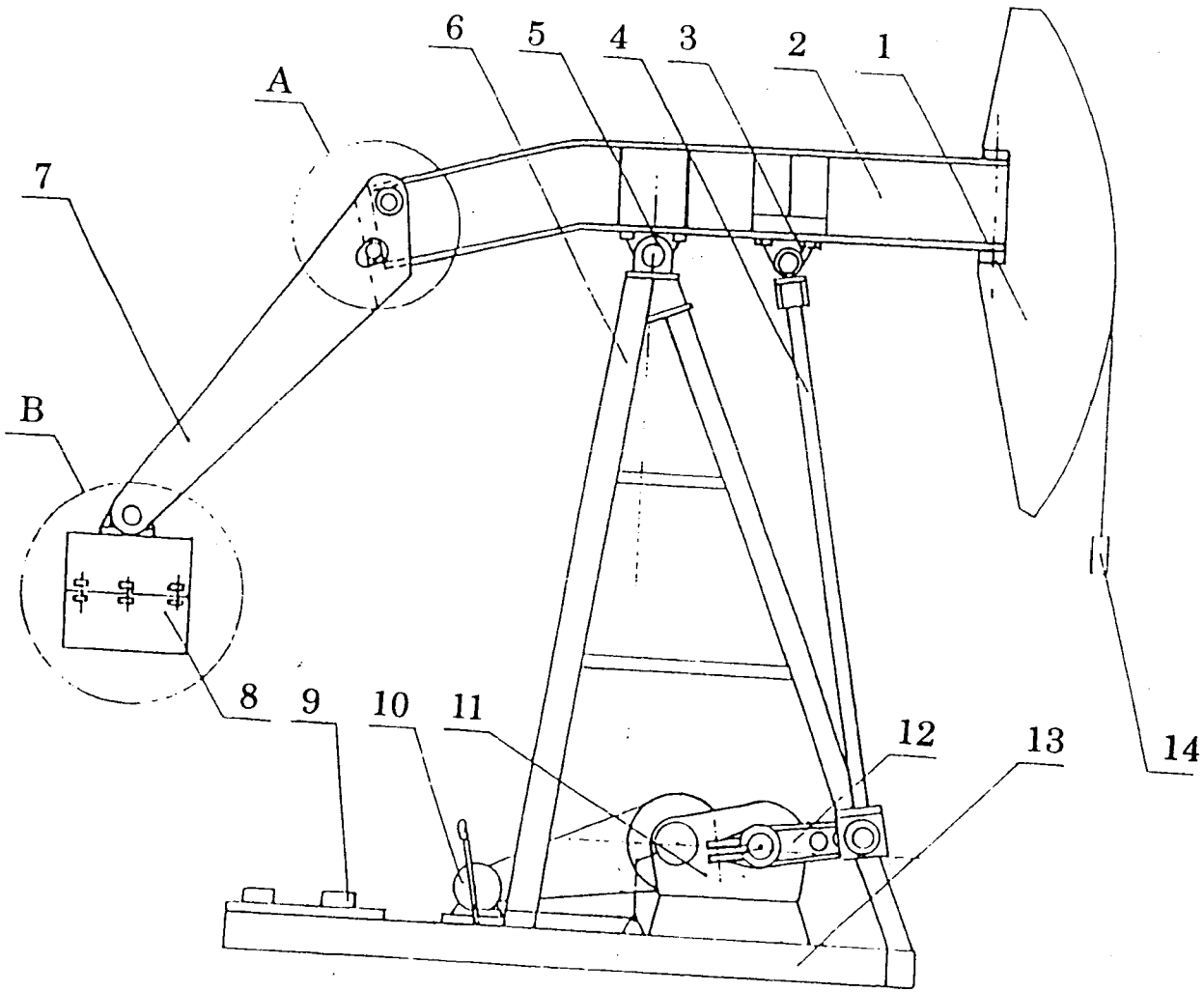
FIG. 1 is a front view showing the structure of the first embodiment of the present invention.

Below is a detailed description of the embodiments of the present invention with reference to the drawings:

As shown in FIG. 1, the said walking beam balanced span and moment regulating economized oil pump consists of an arc 1, a walking beam 2, a support 6, a pitman 4, a base 13, a crank 12, a decelerator 11, a power machine 10, a string device 14. Support 6, crank 12, decelerator 11, power machine 10, and so on are fixed on the base 13. The walking beam 2 is hinged on the support 6 through the central bearing 5, and the pitman 4 is hinged on the crank 12 at one end and on the walking beam 2 at the other end through the bearing 3. The arc 1 is mounted at the front end of the walking beam 2 and the string device is mounted on the arc1. The present invention is characterized in that, the upper or lower part of the front end of the boom 7 is hinged to the rear end of the walking beam 2 while between the lower or upper part of the front end of the boom 7 and the rear end of the walking beam 2 is mounted a weighted arm regulator and at the rear end of the boom is mounted a weighted device.

The principle of the present walking beam balanced span and moment regulating economized oil pump is as follows: when the oil-well technological parameters such as the diameter of the oil pump, the depth of the placement of the pump have been adjusted or when the properties of the oil such as the viscosity and so on have been changed, the difference between the maximum and minimum values of the oil arc suspension point load also varies accordingly. Thereafter the distance between the weighted device and the central bearing (that is, the center of the circle formed by the rotation of the walking beam) is changed by adjusting the weighted arm regulator, thus changing the difference between the maximum effective moment and the minimum one of the weighted device. Such balancing regulation adapts the oil pump to the change that is dependent on the difference between the maximum and minimum values of the suspension point load of the arc, without the need to increase the output of the power machine, thus greatly reducing the consumption of energy and saving energy.

Figure 2:
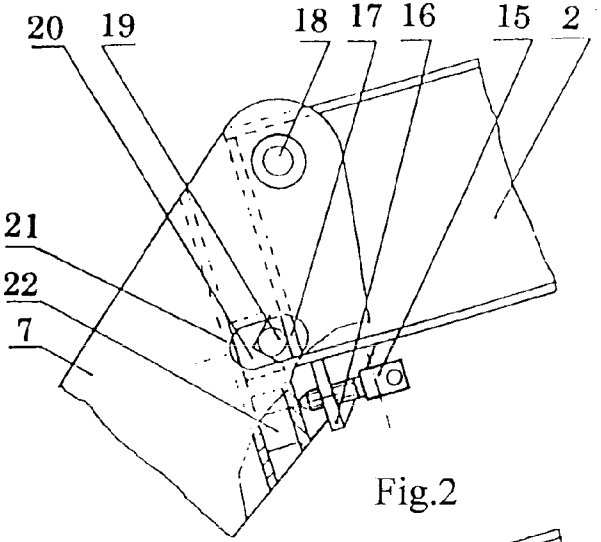
FIG. 2 is a partial enlarged view of the first operation mode of part A illustrated in FIG. 1.

The weighted arm regulator of the present walking beam balanced span and moment regulating economized oil pump can be realized in this way: As shown in FIG. 2, one of the modes of realization of the weighted arm regulator is thus: the said weighted arm regulator consists of an adjustable pin 19 and a mounting hole, and at the lower part of the front end of the boom 7 there is a mounting hole whose diameter is larger than that of the adjustable pin 19, which is placed between the front end of the boom 7 and the rear end of the walking beam 2 through the mounting hole. The angle formed by the boom 7 and the walking beam 2 can be modified by changing the adjustable pin 19 with different diameters, thus modifying the distance between the weighted device and the central bearing (that is, the centre of the circle formed by the rotation of the walking beam) and achieving the difference between the maximum effective moment and the minimum one of the weighted device. The boom 7 is hinged on the walking beam 2 through the pin 18. As shown in FIG. 2, in order to further prevent the adjustable pin 19 from sliding, a seizure 20 containing at least one notch is mounted on the front end of the boom 7 and the rear end of the walking beam 2 corresponding to the mounting hole (Only one notch is represented in FIG. 2). As shown in FIG. 2, in order to make the replacement of the adjustable pin 19 easily, a screw ejector pin base 16 with a screw ejector 15 installed on it is mounted on the walking beam 2 or the boom 7, thus the distance between the upper end of the boom 7 and the rear end of the walking beam 2 can be increased through the screw ejector pin 15, greatly inconveniencing the mounting or dismounting of the adjustable pin roll. In order to save steel materials, the boom 7 and the walking 2 usually are designed in framework structure, with a bearing plate 21 and a baffle plate 17 fixed on the front end of the boom 7 and on the rear end of the walking beam 2 respectively, as shown in FIG. 1, thus making it convenient to mount the weighted device.

Figure 3:
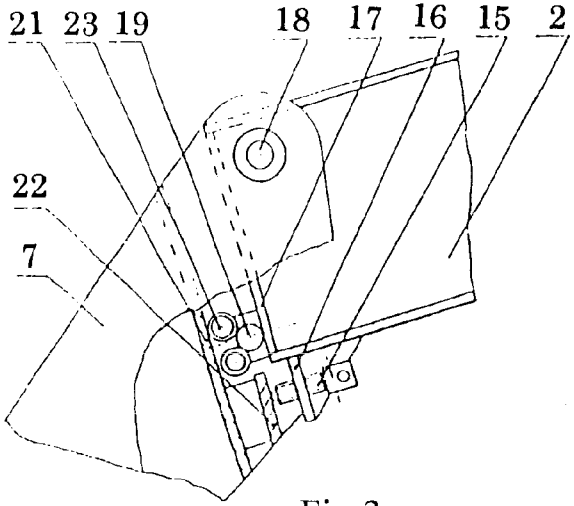
FIG. 3 is a partial enlarged view of the second operation mode of part A illustrated in FIG. 1.

As shown in FIG. 3, the second embodiment of the weighted arm regulator differs from the first embodiment of the same in that the seizure 20 is a pipe rack 23 made of steel material that has at least one notch of which only one is represented in FIG. 3.

Figure 4:
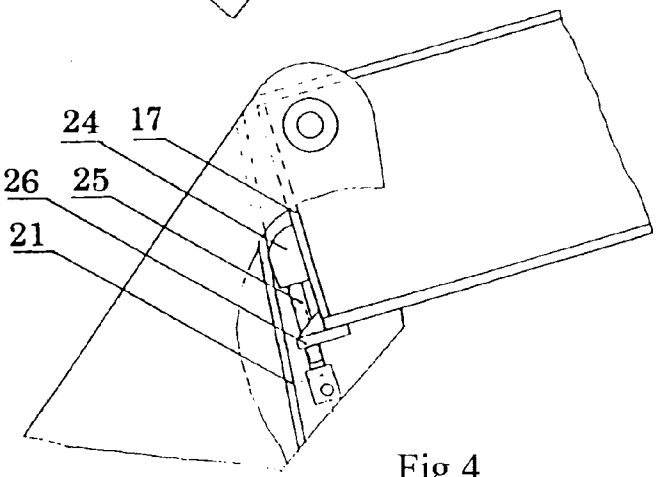
FIG. 4 is a partial enlarged view of the third operation mode of part A illustrated in FIG. 1.

As shown in FIG. 4, the third embodiment of the weighted arm regulator differs from the first embodiment of the same in that the weighted arm regulator consists of a wedge 24 and a lead screw 25, with a base plate 26 of the lead screw being fixed at the front end of the boom 7 or the rear end of the walking beam 2, and the lead screw 25 is mounted on the base plate 26 with the wedge fixed on it. As shown in FIG. 4, the propping position of the wedge 24 can be adjusted by adjusting the lead screw 25 so as to change the angle between the boom 7 and the walking beam 2.

Figure 5:
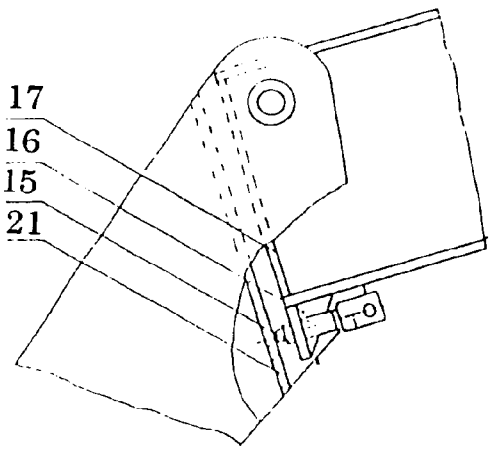
FIG. 5 is a partial enlarged view of the fourth operation mode of part A illustrated in FIG. 1.
Figure 7:
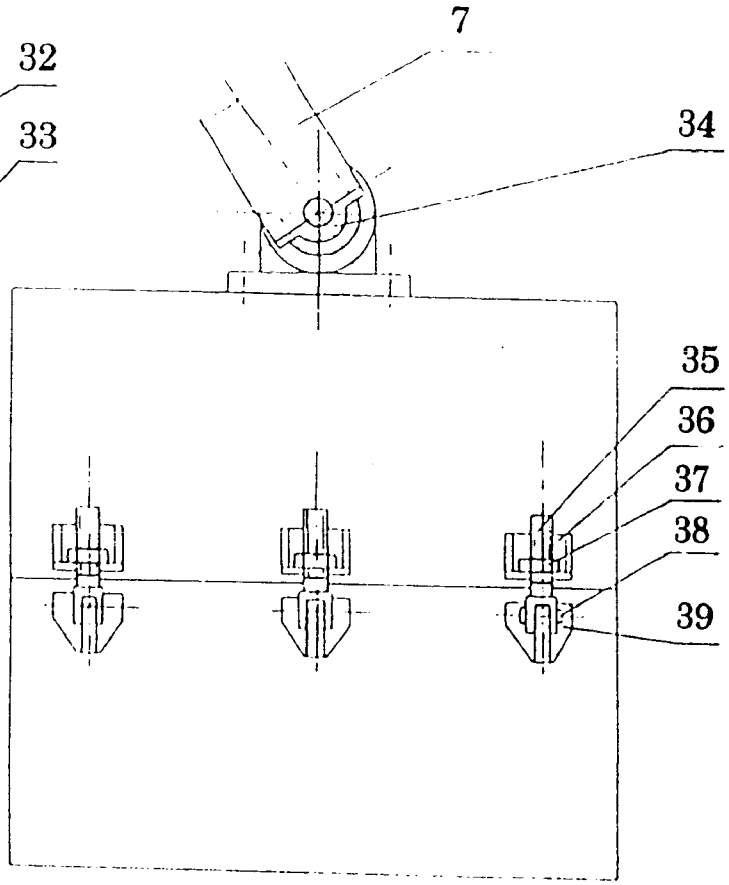
FIG. 7 is a side view of FIG. 6.
Figure 6:
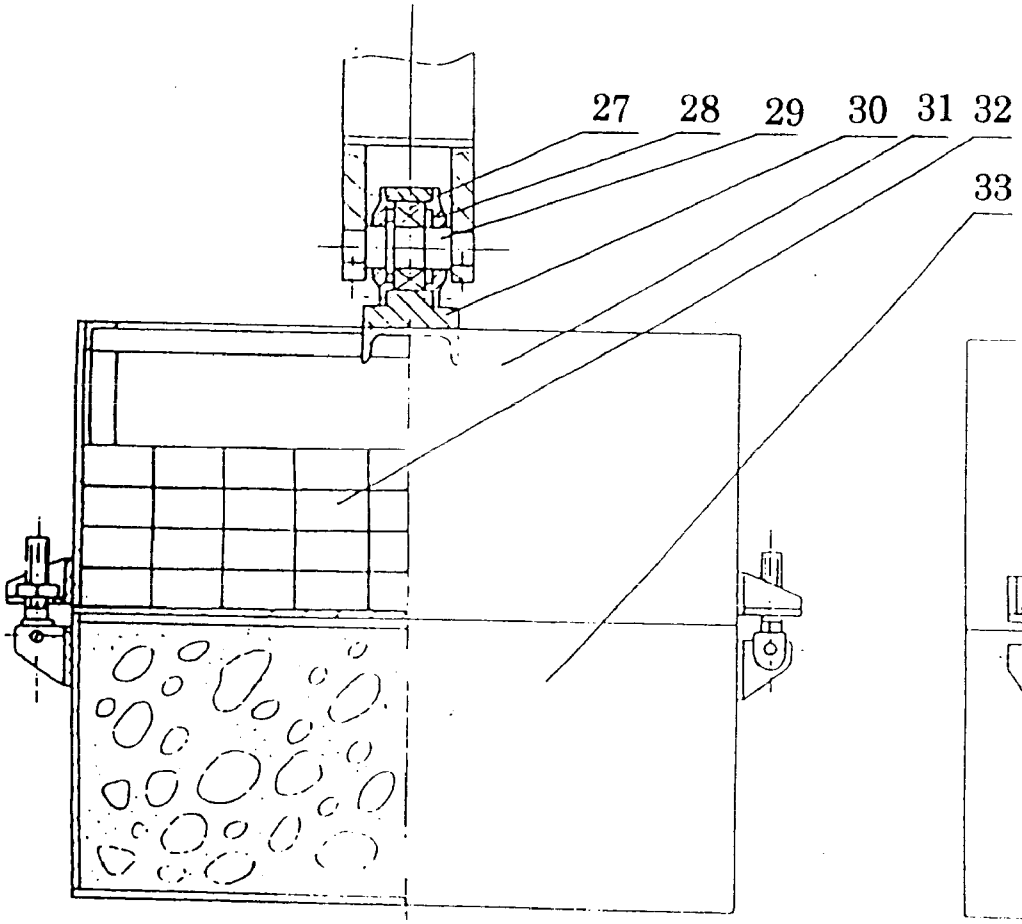
FIG. 6 is a partial enlarged front view of part B in FIG. 1.

As shown in FIG. 5, the fourth embodiment of the weighted arm regulator differs from the first embodiment of the weighted arm regulator in that the weighted arm regulator consists of a screw ejector pin 15 and a screw ejector pin base 16, the latter of which is fixed at the front end of the boom 7 or the rear end of the walking beam 2 and the former mounted on the screw ejector pin base 16 and the modification of the angle between the boom 7 and the walking beam 2 can be effected by adjusting the screw ejector pin 15. The weighted device of the walking beam balanced span and moment regulating economized oil pump can be realized in the following way:

As shown in FIG. 6 and FIG. 7, the weighted device is hinged on the rear end of the boom 7 or articulated to the rear end of the boom 7. The said weighted device consists of an upper weighted box 31 hinged or articulated on the rear end of the boom 7 and a lower weighted box 33, which can be made up of several weighted boxes and can be mounted on the upper weighted box 31 or dismounted from the upper weighted box 31. A weighted block 32 is contained in the upper weighted box 31 whereas the lower weighted box 33 contains materials of high density. The weighted device wherein is hinged on connecting frame 34 at the rear end of the boom 7 through the bearing 27, the bearing cap 28, the hanging bearing 29 and a bearing seat. One of the functions of the weighted device is to balance and bob-weight the walking beam and the second function of the same is that when the maximum and minimum values of the suspension point load of the arc increase or decrease simultaneously, adjustment of the balance of the oil pump can be achieved by adjusting the weight of the weighted device, that is, by increasing or reducing the number of the weighted blocks 32 contained in the upper weighted box 21 or by increasing or reducing the weight of the lower weighted box 33. The third function of the weighted device is tat when there is a load, namely, a sucker rod, suspended on the string device 14 of the oil arc 1, the power machine has to bear a greater load when the oil arc 1, without any load prior to the loading operation, rotates to the lowest point to be loaded. In order to alleviate the load of the power machine at this point, the number of the weighted blocks 32 or the number and quality of the lower weighted boxes 33 can be reduced when the oil arc 1 reaches the highest point, or the lowest point of the weighted device. Then the arc 1 is loaded again when it rotates to the lowest point. Also, when the loaded weighted device reaches the lowest point, the weighted device can be restored to its original weight, thus dispensing with auxiliary operations as well as the installment of a bigger power machine, and the level of energy consumption is thereby greatly reduced.

As shown in FIG. 1, in order to reduce or guard against destruction of the components of the oil pump such as the pitman 4, the boom 7 and the walking beam 2 and so on when the oil arc is being unloaded or loses its load, an unloading bumper bracket 9 is fixed on the corresponding base 13 at the lowest point of the movement of the weighted device, which, during the time of unloading or loading, makes it convenient to install or dismount the weighted box 33, and helps reduce or prevent destruction of the components of the oil pump such as the boom 7 and the walking beam 2 with the support and buffer action of the unloading bumper bracket 9 when, due to an accidental loss of the load of the string device, the weighted device rotates to the lowest position but still within the distortion limits of the components such as the walking beam 2 and so on.

As shown in FIG. 1, the boom 7 is thick at the top and thin at the bottom, constituting a uniform strength beam, thus lowering the cost of the present invention.

As shown in FIG. 1, the boom 7 and the walking beam 2 can form a trapezoid position as well as other shapes such as an angle or an arc. The embodiments of the walking beam balanced span and moment regulating economized oil pump according to the present invention are limited in the representation of the drawings. For example, the boom 7 can be made up of at least two segments, each of which is hinged upon the other at the upper or so lower part of the front end. Besides, a weighted arm regulator is mounted somewhere between the lower part or the upper part of the front end of each segment. FIG. 1 represents only an embodiment of the fore walking beam oil pump. The present invention also includes the embodiments of conventional walking beam oil pump, in which the characters of the walking beam balanced span and moment regulating economized oil pump are substantially similar to those described in the drawings.

The walking beam balanced span and moment regulating economized oil pump according to the present invention is simple in structure, easy to operate, reliable in performance and less costly. In particular, its balance is adjustable as the maximum and the minimum values of the arc suspension point load and the difference between the maximum and the minimum values change. The balance effect is thus improved and the output of the power machine is greatly reduced so as to lower the consumption of energy. Meanwhile, the weighted device makes it convenient to unload, thus the crane is no longer needed in the unloading process and the time of operation and the cost for maintenance are greatly curtailed.

Figure 8:
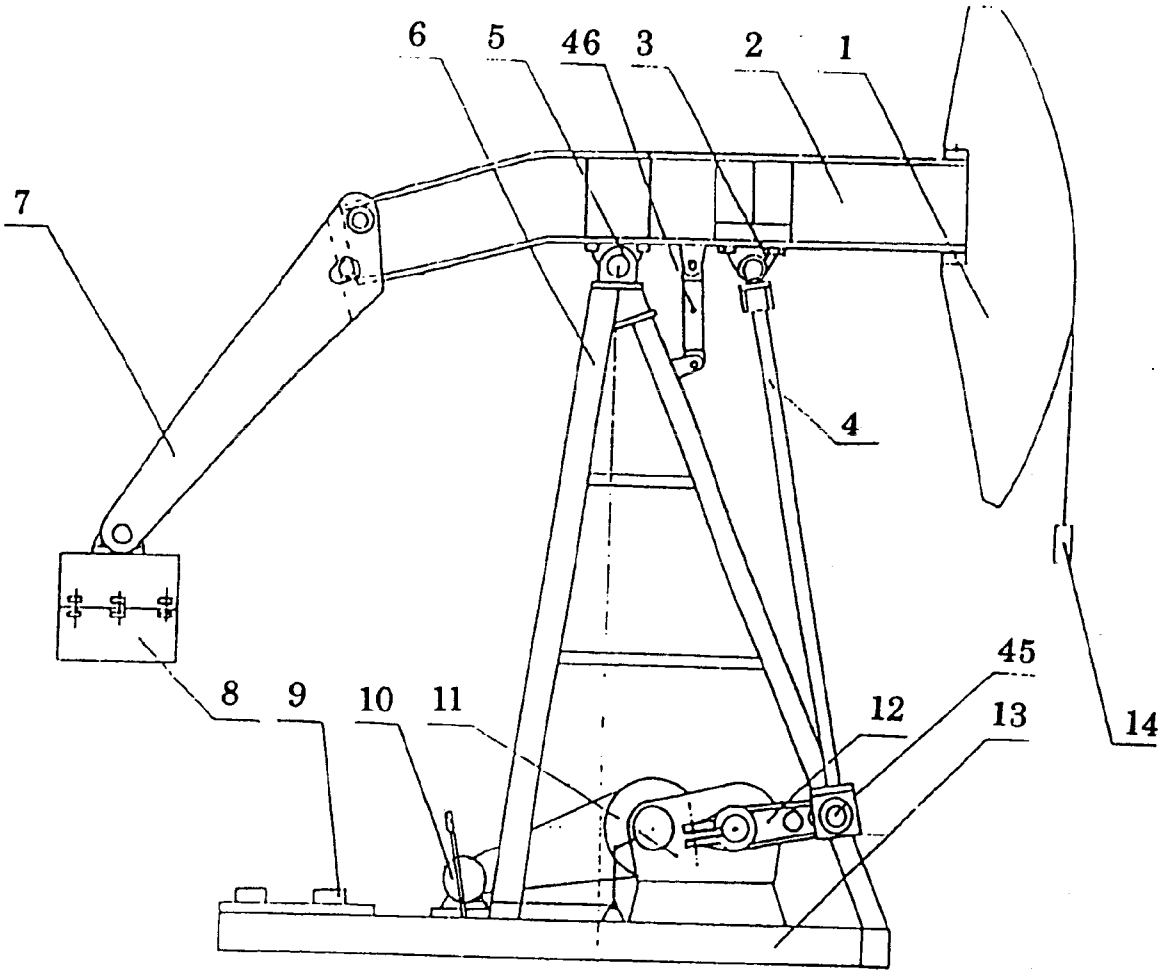
FIG. 8 is a front view showing the structure of the second embodiment of the present invention.

As shown in FIG. 8, the embodiment 2 of the stroke regulating device of the walking beam oil pump consists of an arc 1 a walking beam 2, a support 6, a pitman 4, a base 13, a crank 12, a decelerator 11, a power machine 10, and a string device 14, while the fixing end of the stroke regulating strutting 46 is positioned on the support 6 of the walking beam 2, and either the walking beam 2 or the support 6 that corresponds to the strutting end of the stroke regulating strutting 46 has a hinge housing 47 respectively. In regulating the stroke, the strutting end of the stroke regulating strutting 46 is mounted on the hinge housing 47 of the corresponding walking beam 2 or the support 6 so as to reliably fasten the walking beam.

Figure 9:
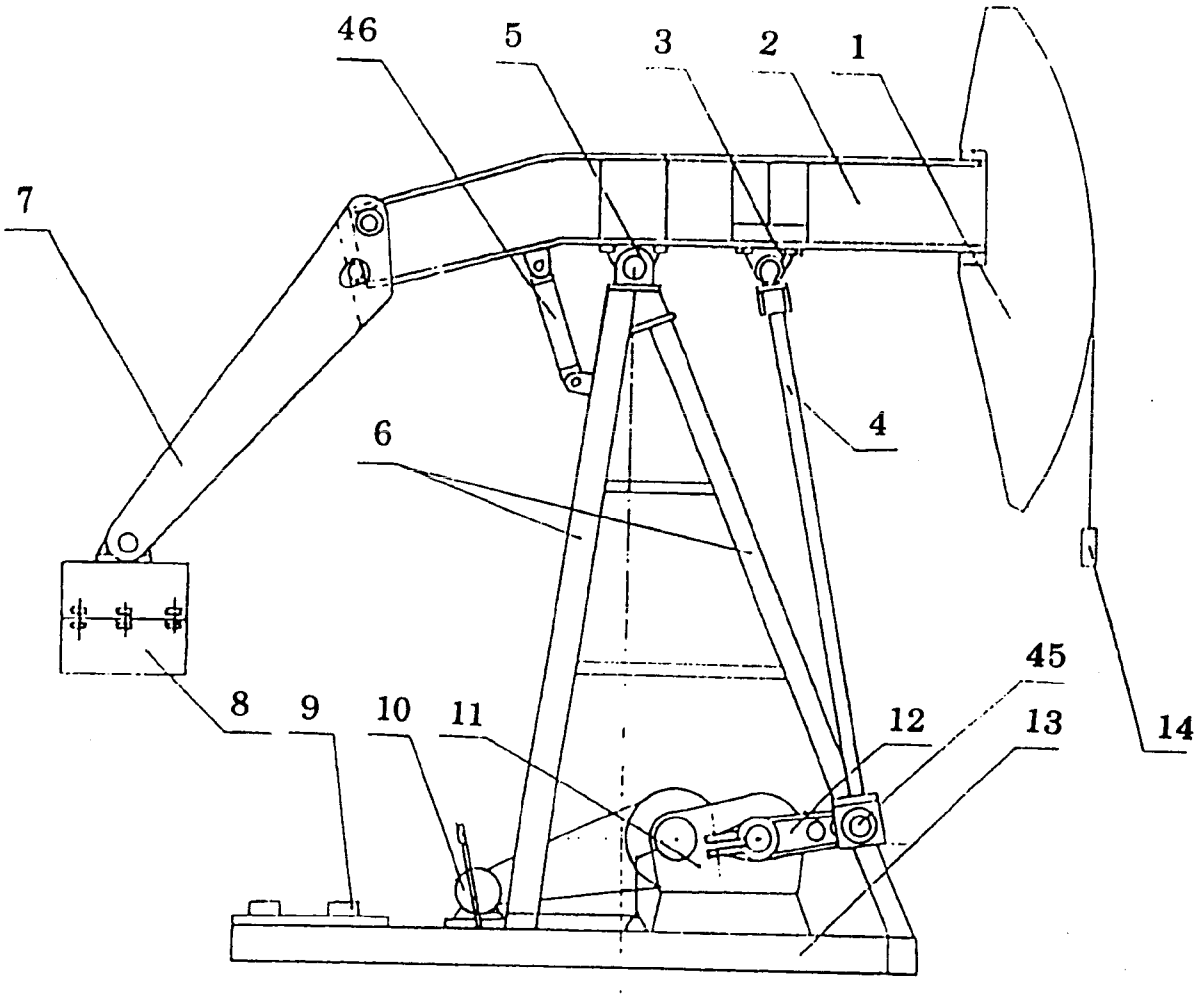
FIG. 9 is a front view showing the structure of the third embodiment of the present invention.

When the adjustment of the stroke is needed, the positions of the arc 1 and the walking beam 2 are first adjusted so that the fixing end of the stroke regulating strutting 46 is positioned on the hinge housing 47 of the corresponding support 6 or the walking beam 2, thus the oil pump is propped and the walking beam 2 pulled. The crank pin assembly 45 connected to the pitman 4 is then taken out of the stroke regulating hole of the crank 12, and a crow bar is inserted into the hinged lever hole 56 to turn the pipe around to align with the pre-adjusted stroke regulating hole of the crank 12. Then the crank pin assembly 45 connected to the pitman 4 is mounted into the desirable stroke regulating holes of the crank 12. Thus the whole process of the adjustment of the stroke is completed. The fixing end of the stroke regulating strutting 46 is dismounted from the hinge housing 47 of the support 6 or the walking beam 2 and the oil pump can continue its operation As shown in FIG. 8 and FIG. 9, the embodiment 3 differs from the embodiment 2 of the present invention in that the mounting positions of the stroke regulating strutting 46 are different.

Figure 10:
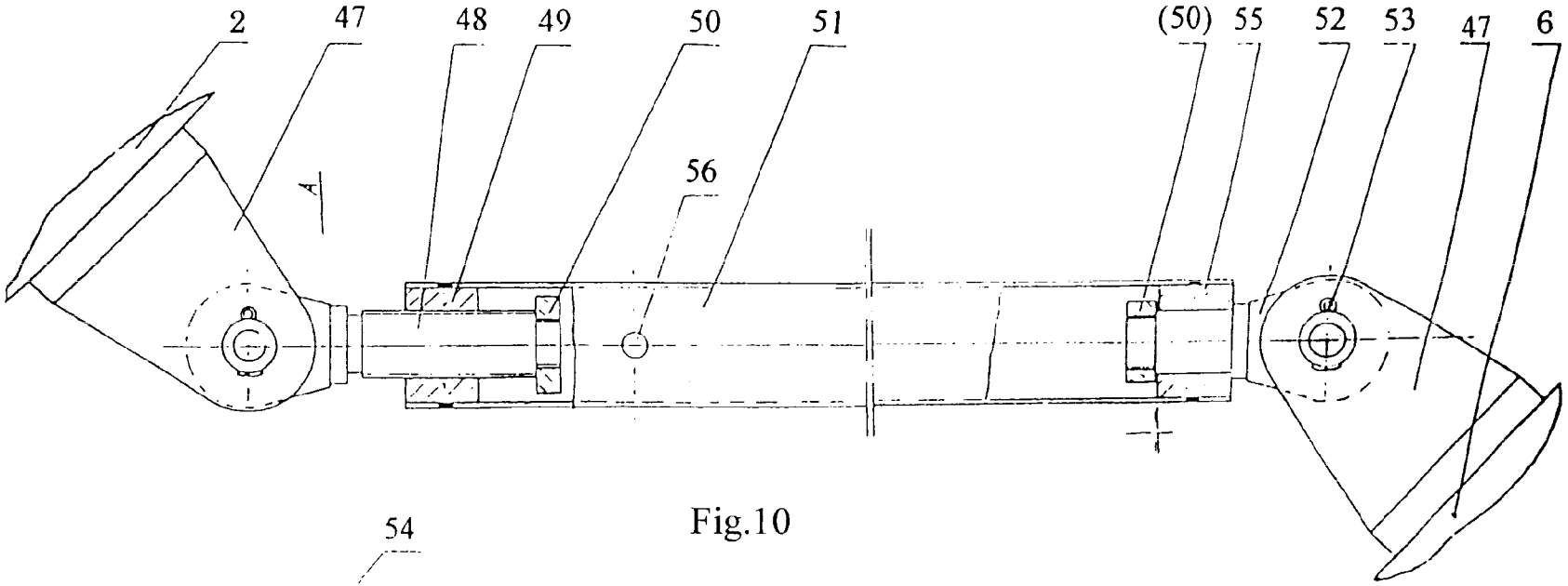
FIG. 10 is a structural representation of the stroke regulating strutting and its fittings illustrated in FIG. 8 or FIG. 9.
Figure 11:
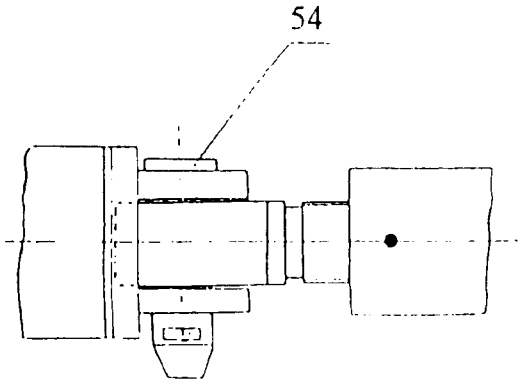

As shown in FIG. 10 and FIG. 11, in order to facilitate the installment and the operation, a guide sleeve 55 is located at the fixing end of the stroke regulating strutting 46, and the fixing end is constituted by the joint 52 mounted together with the guide sleeve 55 via restricting nuts 50; the joint 52 is hinged to the support 6 or the housing 47 of the walking beam 2 through a rotable pin 54; a nut 49 is placed at the strutting end 59 of the stroke regulating strutting 46, and the turnbuckle 48 is mounted on the strutting end through the screw nuts 49; there is a restricting screw nut 50 installed on the inside of the turnbuckle 48; the strutting end of the stroke regulating strutting 46 is hinged on the hinge housing 47; the strutting end of the stroke regulating strutting 46 is hinged on the hinge housing 47 via a rotable pin 54; a split pin 53 is mounted on the rotable pin 54; there is a hinged lever hole 56 on the stroke regulating strutting 46; when the crank pin assembly 45 connected to the pitman 4 is mounted in the desirable stroke regulating hole of the crank 12, the crow bar is inserted into the hinged lever hole 56 to make the stroke regulating strutting 46 rotate and the effective length of the stroke regulating strutting 46 is thus adjusted so as to facilitate the installation.

The walking beam oil pump stroke regulating device of the present invention is simple in structure, convenient for operation, labour-saving and time-saving. No crane is needed when regulating the stroke of an oil pump equipped with the stroke regulating device according to the present invention, thus greatly facilitating and simplifying the stroke regulation, and reducing the duration of the operation and the cost for maintenance.

What is claimed is:

1. A walking beam balanced span and moment regulating oil pump comprising:

an arc, a boom having a front and a rear, a walking beam having a front and a rear, a weighted device, and a weighted arm regulator;

with the arc being connected to the front of the walking beam, the front of the boom being movably connected to the rear of the walking beam, and the weighted device being connected to the boom, with the weighted arm regulator being operably connected to the boom and the walking beam;

wherein the weighted arm regulator comprises an adjustable pin that cooperates with a mounting hole located near the front of the boom and near the rear of the walking beam.

2. A walking beam balanced span and moment regulating oil pump comprising:

an arc, a boom having a front and a rear, a walking beam having a front and a rear, a weighted device, and a weighted arm regulator;

with the arc being connected to the front of the walking beam, the front of the boom being movably connected to the rear of the walking beam, and the weighted device being connected to the boom, with the weighted arm regulator being operably connected to the boom and the walking beam;

wherein The weighted arm regulator comprises a screw ejector pin and a screw ejector pin base, the pin base being fixed at the front of the boom or near the rear of the walking beam, with the screw ejector pin mechanically cooperating with the pin base.

3. A walking beam balanced span and moment regulating oil pump comprising:

an arc, a boom having a front and a rear, a walking beam having a front and a rear, a weighted device, and a weighted arm regulator;

with the arc being connected to the front of the walking beam, the front of the boom being movably connected to the rear of the walking beam, and the weighted device being connected to the boom, with the weighted arm regulator being operably connected to the boom and the walking beam;

wherein the weighted device is pivotally connected to the rear of the boom and comprises an upper weighted box and at least one lower weighted box which is removably mounted on the upper weighted box.

4. A walking beam balanced span and moment regulating oil pump comprising:

an arc, a boom having a front and a rear, a walking beam having a front and a rear, a weighted device, an unloading bumper bracket operably connected to the oil pump such that the bumper bracket serves as a bumper for the weighted device and a weighted arm regulator;

with the arc being connected to the front of the walking beam, the front of the boom being movably connected to the rear of the walking beam, and the weighted device being connected to the boom, with the weighted arm regulator being operably connected to the boom and the walking beam.

* * * * *